US006155642A

United States Patent [19]

Kawakami et al.

[11] Patent Number: 6,155,642

[45] Date of Patent: Dec. 5, 2000

[54] BARBER/BEAUTY CHAIR

[75] Inventors: Toshiaki Kawakami; Tadashi Ijichi, both of Hiji-machi, Japan

[73] Assignee: Oohiro Works, Ltd., Japan

[21] Appl. No.: 09/340,262

[22] Filed: Jun. 30, 1999

[30] Foreign Application Priority Data

Jul. 2, 1998 [JP] Japan ..... 10-187743

[51] Int. Cl.[7] ..... A61G 15/06; A47C 1/04

[52] U.S. Cl. ..... 297/344.16; 248/421

[58] Field of Search ..... 297/344.15, 344.16, 297/344.17; 248/157, 414, 421

[56] References Cited

U.S. PATENT DOCUMENTS

| | | | |
|---|---|---|---|
| 3,596,982 | 8/1971 | Grams | 297/344.17 X |
| 3,698,673 | 10/1972 | Olsen | 248/421 |
| 3,964,725 | 6/1976 | Matsui et al. | 248/421 |
| 4,173,372 | 11/1979 | Nomi | 297/344.17 |
| 4,344,594 | 8/1982 | Hirth | 248/421 |

FOREIGN PATENT DOCUMENTS 62-188249 11/1987 Japan .

*Primary Examiner*—Peter R. Brown
*Attorney, Agent, or Firm*—Burr & Brown

[57] ABSTRACT

The present invention provides a barber/beauty chair which can freely set the lowest position and a movable area of an ascendable/descendable seat part as well as hoist and lower the seat part horizontally without displacement of the center position of the seat part. The barber/beauty chair according to the present invention comprises a hoisting/lowering mechanism which is constituted by a frame 31 stood on a base, a link bracket 31, a pedestal part 33 for supporting a seat part 24, a first parallel link 50 having one end attached to the frame 31 and the other end attached to the link bracket 32, a second parallel link 60 having one end attached to the pedestal part 33 and the other end attached to the link bracket 32, a third link rod 70 for connecting the first parallel link 50 and the second parallel link 60, and an oil hydraulic cylinder 80 connected to the second parallel link 60.

2 Claims, 5 Drawing Sheets

BARBER/BEAUTY CHAIR

FIELD OF THE INVENTION

The present invention relates to improvement of a barber/beauty chair which is principally used in a beauty salon or a barbershop.

BACKGROUND OF THE INVENTION

A barber/beauty chair having a seat part which a person under hairdressing sits on and is moved upward and downward by a hoisting/lowering mechanism has been widely used in a beauty salon or the like. The up and down operation of the barber/beauty chair is performed by a method for hoisting/lowering the seat part directly by an oil hydraulic cylinder or a method for hoisting/lowering the seat part by combining the oil hydraulic cylinder and a parallel link.

The barber/beauty chair using the method for hoisting/lowering the seat part directly by the oil hydraulic cylinder has an oil hydraulic cylinder device on a base of the barber/beauty chair and the seat part at a tip side of the oil hydraulic cylinder device. The height of the seat part is adjusted by expanding or contracting the oil hydraulic cylinder.

Generally, it is desired that an ascendable/descendable seat part can be moved into a position as low as possible in order to set the seat part in a position so that a person under hairdressing can easily sit. On the other hand, it is desired that the seat part can be moved as widely as possible so that a hairdresser sets the head of the person under hairdressing in a position where the hairdresser can easily work.

When using the above-mentioned barber/beauty chair, in order to make the lowest position of the seat part lower, a body of the cylinder device which is situated between the base and the seat part should be made shorter. However, the cylinder device having a shorter body has a shorter piston part, resulting in a shorter extendable stroke, whereby the seat can be moved less widely. Therefore, it is difficult to make the lowest position of the seat part lower as well as extend the movable area of the seat part.

On the other hand, the barber/beauty chair using the method for hoisting/lowering the seat part by combining the oil hydraulic cylinder and the parallel link can make the lowest position of the seat part lower as well as extend the movable area of the seat part.

FIG. 5 is a sectional view illustrating a hoisting/lowering mechanism of a prior art barber/beauty chair which uses the method for hoisting/lowering a seat by combining the oil hydraulic cylinder and the parallel link.

In the figure, reference numeral 1 designates a hoisting/lowering mechanism of the barber/beauty chair. The hoisting/lowering mechanism 1 comprises a base 2, a support 3 stood on the base 2, an upper link 4 having one end attached to the support 3, a lower link 5 which is disposed below the upper link 4 and has one end attached to the support 3, a seat supporting arm 7 which is attached to the other end of the upper link 4 and the other end of the lower link 5, a pedestal part 9 attached to the seat supporting arm 7, an oil hydraulic cylinder 10 attached to the base 2, and an oil hydraulic pump 13.

The upper link 4 and the lower link 5 are parallel links which are disposed in parallel with each other. One end of each link is rotatably connected to the support 3 by a shaft 6 and the other end of each link is rotatably connected to the seat supporting arm 7 by a shaft 8. In addition, a piston rod of the oil hydraulic cylinder 10 is rotatably connected by a shaft 12 to a bracket 11 which is attached to the upper link 4.

Further, a seat which a person under hairdressing sits on is attached to an upper part of the pedestal part 9, but it is not shown in the figure.

Hereinafter, the noising/lowering operation of the pedestal part 9 by the hoisting/lowering mechanism 1 will be described.

In order to move the pedestal part 9 upward from the lowest position as shown in FIG. 5, the oil hydraulic pump 13 applies the pressure to the oil hydraulic cylinder 10 and the piston rod of the oil hydraulic cylinder 10 is expanded. Thereby, the upper link 4 and the lower link 5 rotate upwardly and the pedestal part 9 is moved upward with always keeping a horizontal state. A hairdresser moves the pedestal part 9 until the position of the head of the person sitting on the seat equipped on the upper part of the pedestal part 9 reaches a position which is suitable for works such as hairdressing.

On the other hand, when the pedestal part 9 is moved downwardly, the oil hydraulic pump 13 decreases the pressure of the oil hydraulic cylinder 10 and the piston rod of the oil hydraulic cylinder 10 is contracted. Thereby, the upper link 4 and the lower link 5 rotate downwardly and the pedestal part 9 is moved downwardly with always keeping the horizontal state.

A movable area of the pedestal part 9 can be adjusted by setting appropriately a connection position between the piston rod of the oil hydraulic cylinder 10 and the upper link 4. That is, the movable area of the pedestal part 9 becomes wider as the connection position approaches the shaft 6 while it becomes narrower as the connection position approaches the shaft 8.

In this way, according to the barber/beauty chair using the method for hoisting/lowering the seat by combining the oil hydraulic cylinder and the parallel link, the movable area of the pedestal part can be set arbitrarily by adjusting the connecting position between the oil hydraulic cylinder and the parallel link, whereby the lowest position of the seat of the barber/beauty chair can be made sufficiently low and the movable area of the seat can be wider.

In a beauty salon or the like, the hairdressing is usually performed together with hair washing and a barber/beauty chair having an ascendable/descendable seat is used also in washing hair. In this case, there are following problems.

When the pedestal part 9 is hoisted/lowered by the hoisting/lowering mechanism as shown in FIG. 5, the hoisting/lowering movement of the pedestal part 9 corresponds to rotational motions of the upper link 4 and the lower link 5 around the shaft 6. Therefore, there is displacement 1 between a center position A of the pedestal part 9 in the lowest position and a center position B of the pedestal part 9 situated at a height.

Since this displacement 1 varies in accordance with an amount of the hoisting/lowering movement of the seat of the barber/beauty chair, the distance between the seat of the barber/beauty chair and a hair washing stand varies during the hoisting/lowering operation, whereby it is difficult to adjust the height of the seat from the hair washing stand.

Further, when the displacement is quite large, the barber/beauty chair itself may be unstable. Therefore, it is necessary to consider the displacement sufficiently in designing the barber/beauty chair.

SUMMARY OF THE INVENTION

The present invention is made to solve the above-mentioned problems, and an object of the present invention is to provide a barber/beauty chair having an ascendable/descendable seat part which has the lowest position and a movable area which can be set freely, and can be hoisted/lowered horizontally without displacement of the center position of the seat part.

Other objects and advantages of the invention will become apparent from the detailed description that follows. The detailed description and specific embodiments described are provided only for illustration since various additions and modifications within the spirit and the scope of the invention will be apparent to those skill in the art from the detailed description.

According to a first aspect of the present invention, a barber/beauty chair which has a mechanism for hoisting/lowering a seat part with keeping the seat part horizontal to a base part comprises a first parallel link having one end side which is rotatably connected to the base part and the other end side which is rotatably connected to a connecting member, a second parallel link having one end side which is rotatably connected to the connecting member and the other end side which is rotatably connected to the seat part, a cylinder device for rotating the second parallel link, the cylinder device having a base end side which is rotatably connected to the base part and a tip side which is rotatably connected to the second parallel link, and a connection link for connecting a rotational motion of the first parallel link and a rotational motion of the second parallel link in opposed directions with each other, the connecting link having one end side which is rotatably connected to the first parallel link and the other end side which is rotatably connected to the second parallel link. Since opposed rotational motions of the two sets of the parallel links are connected with each other by the connecting link, the displacements resulting from the rotational motions of the parallel links are cancelled out each other, whereby the seat part can be moved upward and downward with being kept horizontal and without displacement of the center position. Therefore, the lowest position and the movable area of the ascendable/descendable seat part can be set freely and the barber/beauty chair which can hoist/lower the seat part horizontally without displacement of the center position of the seat part can be obtained.

According to a second aspect of the present invention, a barber/beauty chair which has a mechanism for hoisting/lowering a seat part with keeping the seat part horizontal to a base part comprises a first parallel link having one end side which is rotatably connected to the base part and the other end side which is rotatably connected to a connecting member, a second parallel link having one end side which is rotatably connected to the connecting member and the other end side which is rotatably connected to the seat part, a cylinder device for rotating the first parallel link, the cylinder device having a base end side which is rotatably connected to the base part and a tip side which is rotatably connected to the first parallel link, and a connecting link for connecting a rotational motion of the first parallel link and a rotational motion of the second parallel link in opposed directions with each other, the connecting link having one end side which is rotatably connected to the first parallel link and the other end side which is rotatably connected to the second parallel link. Since opposed rotational motions of the two sets of the parallel links are connected with each other by the connecting link, the displacements resulting from the rotational motions of the parallel links are cancelled out each other, whereby the seat part can be moved upward and downward with being kept horizontal and without displacement of the center position. Therefore, the lowest position and the movable area of the ascendable/descendable seat part can be set freely and the barber/beauty chair which can hoist/lower the seat part horizontally without displacement of the center position of the seat part can be obtained.

DETAILED DESCRIPTION OF THE PREFERRED EMBODIMENTS

Hereinafter, embodiments of the present invention will be described.

Embodiment 1

Figure 1:
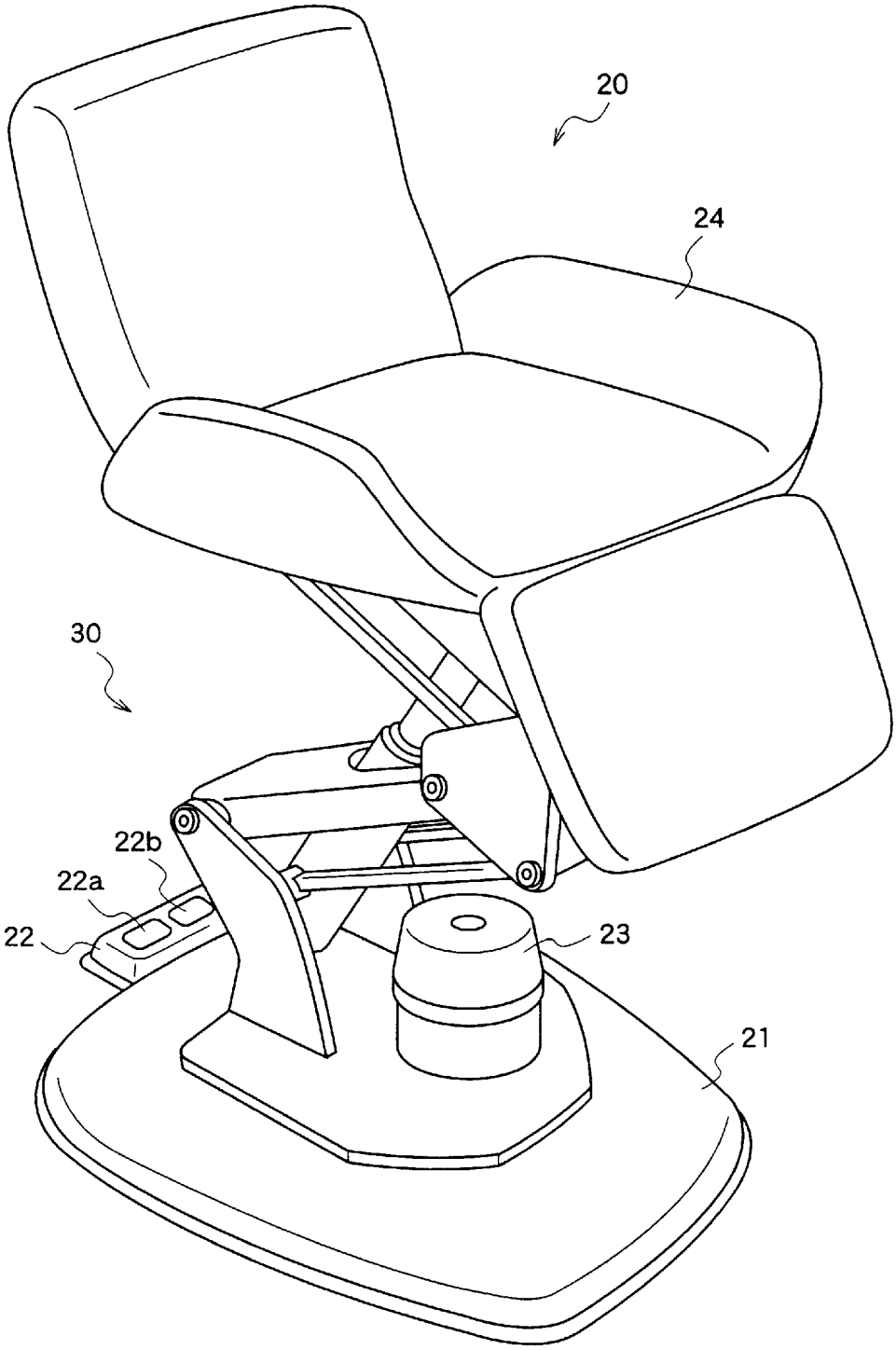
FIG. 1 is an outside perspective view illustrating a barber/beauty chair according to a first embodiment of the present invention and shows a state in which a seat part is moved upward into a position.

FIG. 1 is an outside perspective view illustrating a barber/beauty chair 20 according to the first embodiment of the present invention.

In the figure, the barber/beauty chair 20 comprises a base 21, hoisting/lowering foot switches 22 equipped on a side part of the base 21, an oil hydraulic pump 23 and a hoisting/lowering mechanism 30 which are established at an upper part of the base 21, and a seat part 24 equipped at an upper part of the hoisting/lowering mechanism 30.

In addition, the hoisting/lowering foot switches 22 have a hoisting switch 22*a* and a lowering switch 22*b*.

The barber/beauty chair 20 according to the first embodiment has the hoisting/lowering mechanism 30 which is constituted by combining an oil hydraulic cylinder and a parallel link mechanism, and the seat part 24 can be moved upward and downward with keeping the seat part 24 horizontal by the hoisting/lowering mechanism 30.

Hereinafter, respective parts will be described in detail.

Figure 2:
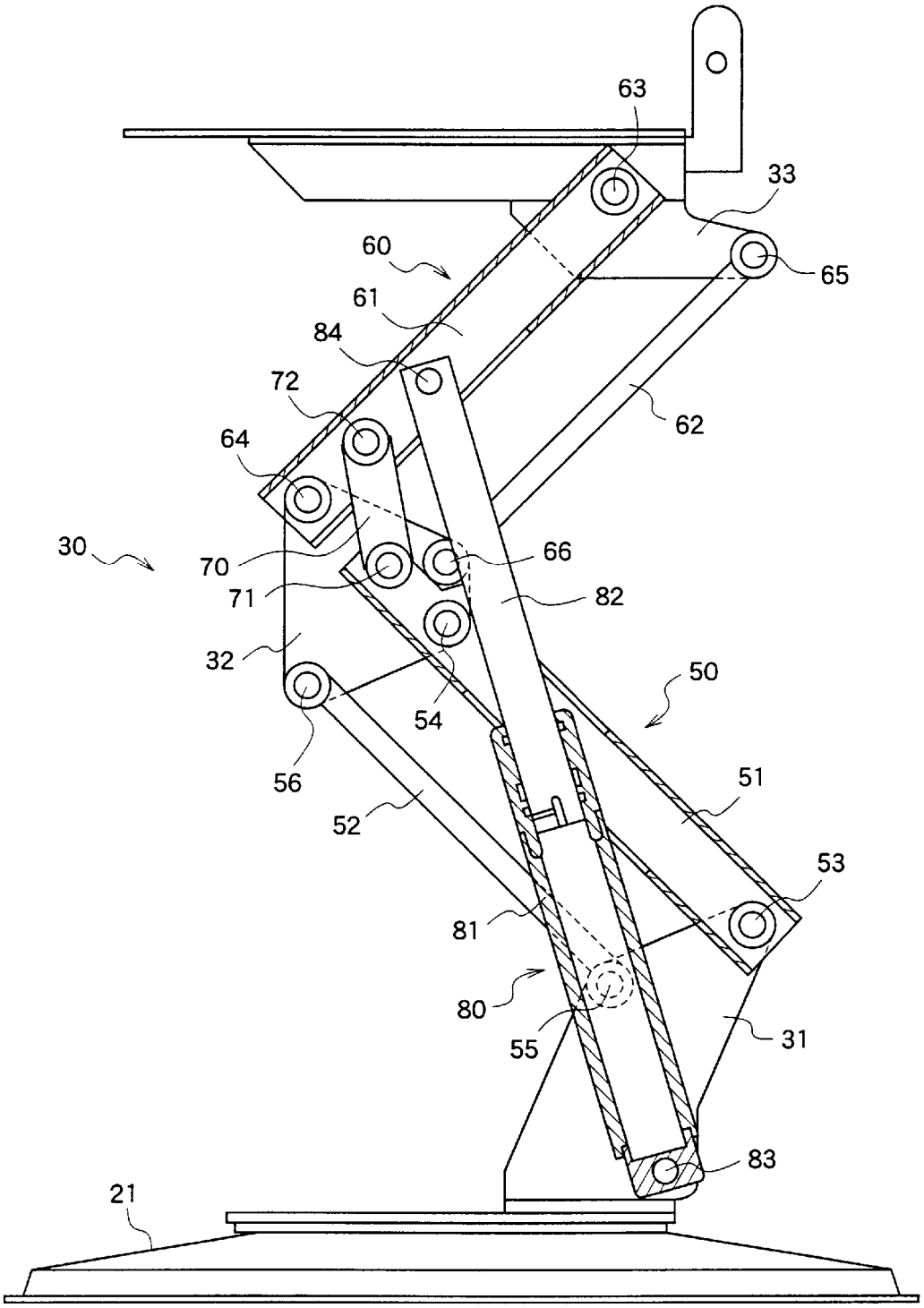
FIG. 2 is a sectional view illustrating a hoisting/lowering mechanism part according to the first embodiment and shows a state where the seat part is moved upward into an arbitrary position.
Figure 3:
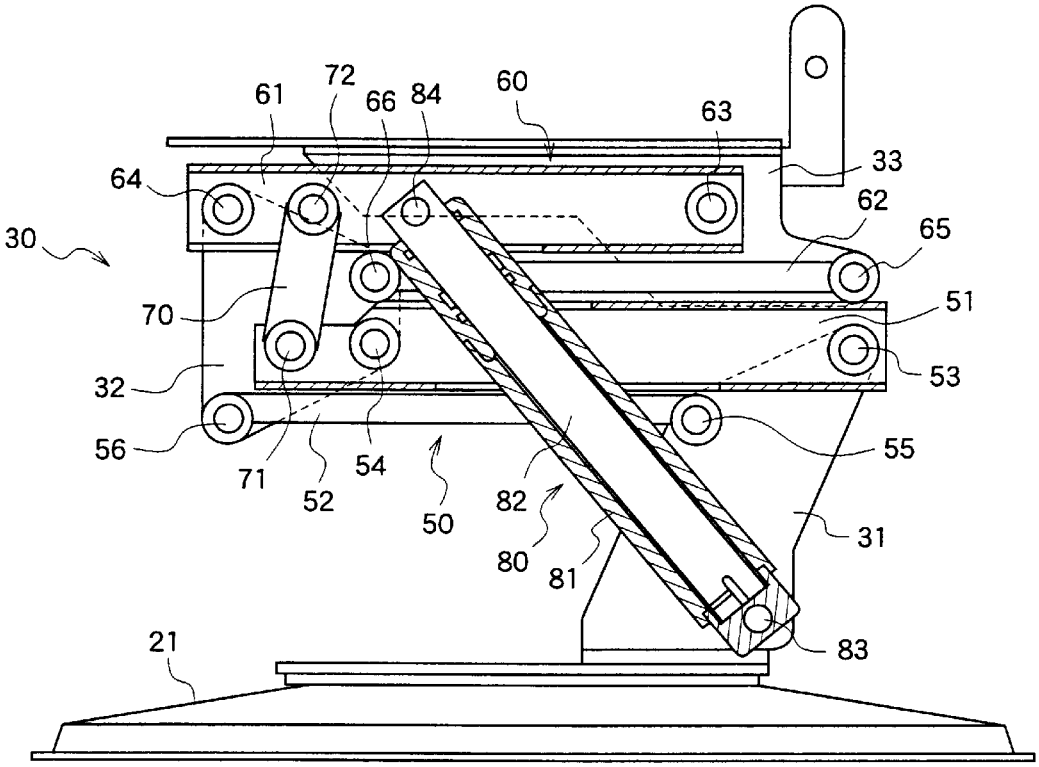
FIG. 3 is a sectional view illustrating the hoisting/lowering mechanism and shows a state where the seat part is situated in the lowest position.

FIGS. 2 and 3 are sectional views illustrating the hoisting/lowering mechanism 30 of the barber/beauty chair 20. Here, FIG. 2 shows the hoisting/lowering mechanism 30 when the seat part 24 is moved upward into an arbitrary position and FIG. 3 shows the hoisting/lowering mechanism 30 when the seat part 24 is situated in the lowest position.

The hoisting/lowering mechanism 30 established at an upper part of the base 21 comprises a frame 31 which is stood on an upper part of the base 21, a first parallel link 50 having one end side which is rotatably connected to the frame 31 and the other end side which is rotatably connected to a link bracket 32 as a connecting member, the link bracket 32, and a second parallel link 60 having one end side which is rotatably connected to a pedestal part 33 and the other end side which is rotatably connected to the link bracket 32, the pedestal part 33 for supporting the seat part 24 (not shown), a third link rod 70 for connecting the first parallel link 50 and the second parallel link 60 with each other, and an oil hydraulic cylinder 80 which is equipped on the frame 31 and connected to the second parallel link 60.

The first parallel link 50 comprises a first link rod 51 and a first pull rod 52. As shown in FIG. 2, the first link rod 51 has an end side which is rotatably connected to the frame 31 by a shaft 53. In addition, the first pull rod 52 is disposed below the first link rod 51 and has an end side which is rotatably connected to the frame 31 by a shaft 55. Further, the other end side of the first link rod 51 is rotatably connected to the link bracket 32 by a shaft 54. The other end side of the first pull rod 52 is rotatably connected to the like bracket 32 by a shaft 56.

The second parallel link 60 comprises a second link rod 61 and a second pull rod 62. As shown in FIG. 2, the second link rod 61 has an end side which is rotatably connected to the pedestal part 33 by a shaft 63. In addition, the second pull rod 62 is disposed below the second link rod 61 and has an end side which is rotatably connected to the pedestal part 33 by a shaft 65. Further, the other end side of the second link rod 61 is rotatably connected to the link bracket 32 by a shaft 64. The other end side of the second pull rod 62 is rotatably connected to the link bracket 32 by a shaft 66.

The third link rod 70 has an end which is rotatably connected by a shaft 71 to the other end side of the first link rod 51 at a position which is nearer to the other end of the first link rod 51 than the shaft 54, as shown in FIG. 2. Further, the other end of the third link rod 70 is rotatably connected to the second link rod 61 by a shaft 72.

The oil hydraulic cylinder 80 has a cylinder tube 81 and a piston rod 82. The oil hydraulic cylinder 80 is connected to the oil hydraulic pump 23 (not shown) by piping or the like and pressure is applied to or reduced from the oil hydraulic cylinder 80 by the oil hydraulic pump 23 by operating the hoisting/lowering foot switches 22.

As shown in FIG. 2, the cylinder tube 81 has a base end which is rotatably connected to the frame 31 by a cylinder shaft 83. In addition, the piston rod 82 has a tip which is rotatably connected to the second link rod 61 by a shaft 84.

Hereinafter, the hoisting/lowering movement of the seat part 24 by the hoisting/lowering mechanism 30 will be described.

When the seat part 24 is moved upward from the lowest position as shown in FIG. 3, a hairdresser steps on the hoisting switch 22*a* and then the oil hydraulic pump 23 applies pressure to the oil hydraulic cylinder 80, thereby expanding the piston rod 82. Thereby the second parallel link 60 rotates upwardly using the shafts 64 and 66 as axes. In this case, the third link rod 70 pulls up the first parallel link 50 with the rotational motion of the second parallel link 60. Thereby, the first parallel link 50 rotates upwardly using the shafts 53 and 55 as axes. As a result, the pedestal part 33 is moved upward with keeping a horizontal state.

In this case, since the second parallel link 60 rotates in a counterclockwise direction around the shafts 64 and 66, the center position of the pedestal part 33 is moved forward as the pedestal part 33 is moved upward. However, since the first parallel link 50 rotates in a clockwise direction around the shafts 53 and 55 in connection with the rotational motion of the second parallel link 60, the link bracket 32 is moved backward as much as the center position of the pedestal part 33 is moved forward, whereby the center position of the pedestal part 33 is not displaced.

On the other hand, when the seat part 24 is moved downward, the hairdresser steps on the lowering switch 22*b* and then the oil hydraulic pump 23 decreases the pressure of the oil hydraulic cylinder 80, thereby contracting the piston rod 82. Thereby, the second parallel link 60 rotates downward using the shafts 64 and 66 as axes. In this case, the third link rod 70 pushes down the first parallel link 50 with the rotational motion of the second parallel link 60. Thereby, the fist parallel link 50 rotates downward using the shafts 53 and 55 as axes. As a result, the pedestal part 33 is moved downward with keeping the horizontal state.

Here, since the second parallel link 60 rotates in a clockwise direction around the shafts 64 and 66, the center position of the pedestal part 33 is moved backward as the pedestal part 33 is moved downward. However, since the first parallel link 50 rotates in a counterclockwise direction around the shafts 53 and 55 in connection with the rotational motion of the second parallel link 60, the link bracket 32 is moved forward as much as the center position of the pedestal part 33 is moved backward, whereby the center position of the pedestal part 33 is not displaced.

In this way, the barber/beauty chair 20 according to the first embodiment of the present invention has the hoisting/lowering mechanism 30 comprising two sets of the parallel links, one set of the parallel link being disposed below the other set of the parallel link, and the rotational motion of the first parallel link 50 and the rotational motion of the second parallel link 60 which are in directions opposed with each other are connected with each other by the third link rod 70. Therefore, the displacements resulting from the rotational motions of the parallel links are cancelled out each other, whereby the seat part 24 can be moved upward and downward with being kept horizontal without displacement of the center position as well as the lowest position and the movable area of the seat part can be set freely.

Embodiment 2

While the piston rod 82 is connected to the second link rod 61 in the hoisting/lowering mechanism 30 according to the first embodiment, the piston rod 82 is connected to the first link rod 51 in a hoisting/lowering mechanism 30' according to the second embodiment.

Figure 4:
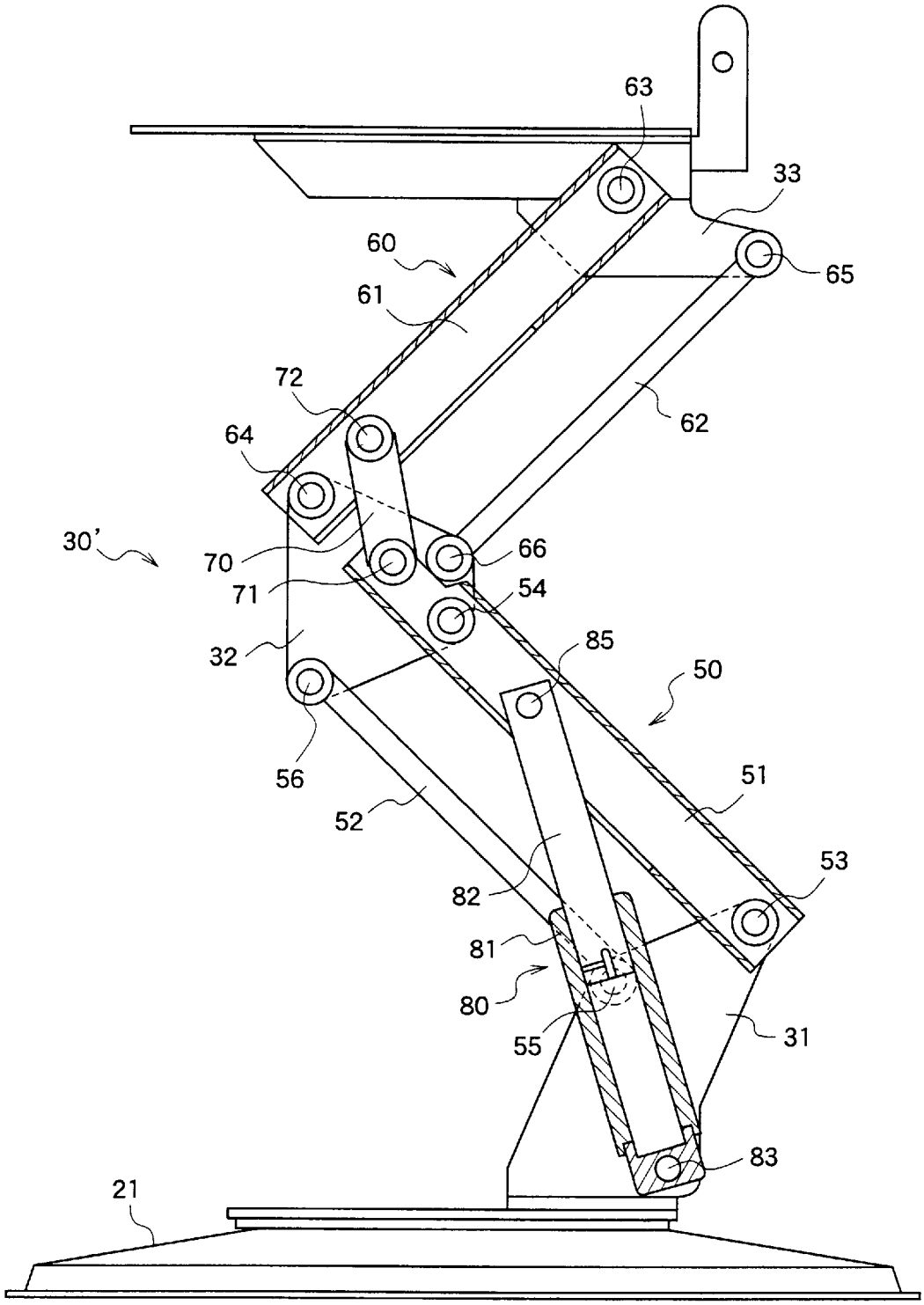
FIG. 4 is a sectional view illustrating a hoisting/lowering mechanism according to a second embodiment and shows a state where a seat part is moved upward into an arbitrary position.
Figure 5:
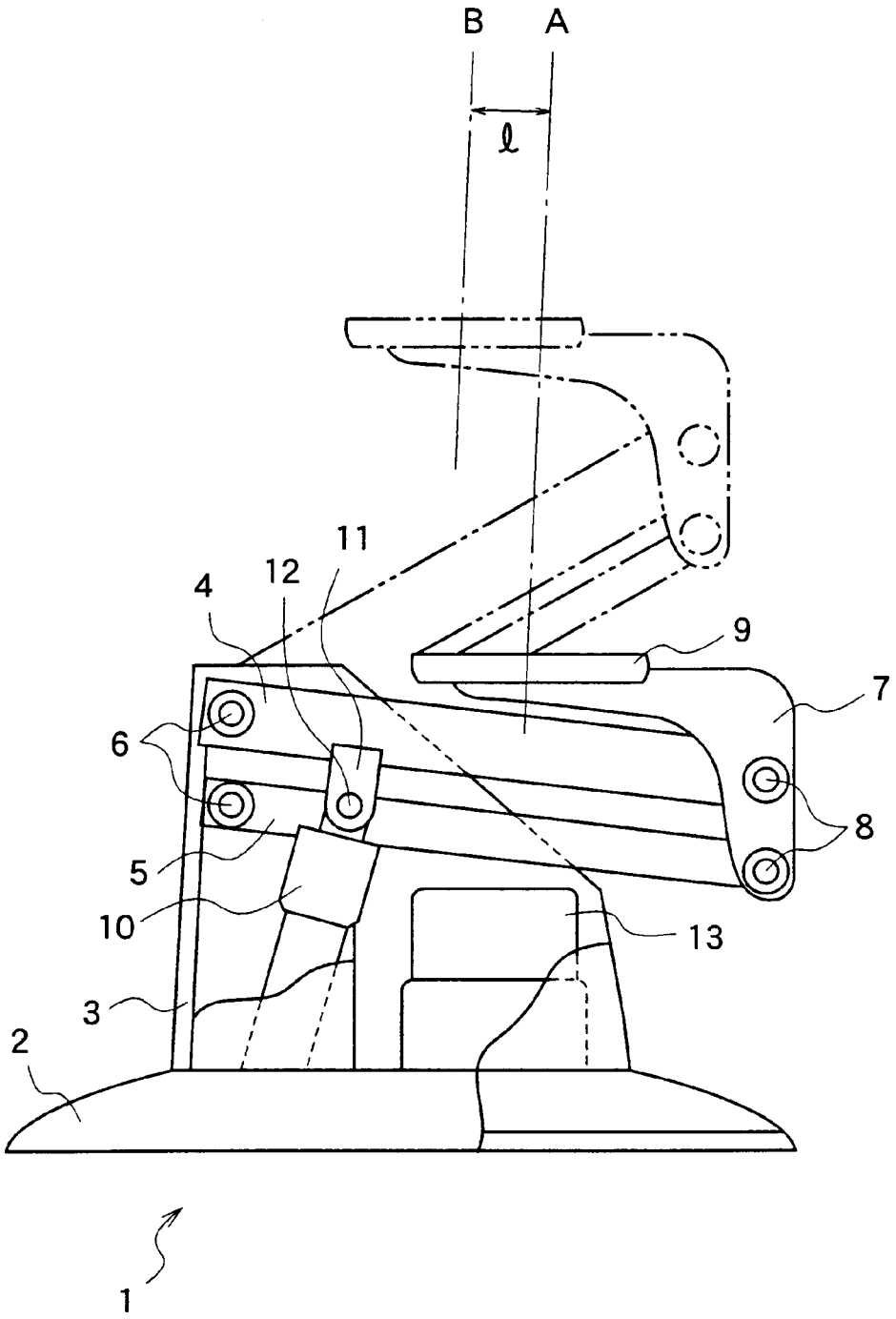
FIG. 5 is a sectional view illustrating a hoisting/lowering mechanism of a prior art barber/beauty chair.

A barber/beauty chair according to the second embodiment has the hoisting/lowering mechanism 30' which is constituted by combining the oil hydraulic cylinder and the parallel link mechanism. As shown in FIG. 4, the hoisting/lowering mechanism 30' which is established on an upper part of the base 21 comprises the frame 31 which is stood on an upper part of the base 21, the first parallel link 50 having one end side which is rotatably connected to the frame 31 and the other end side which is rotatably connected to the link bracket 32, the link bracket 32, the second parallel 60 having one end side which is rotatably connected to the pedestal part 33 and the other end side which is rotatably connected to link bracket 32, the pedestal part 33 for supporting the seat part 24 (not shown), the third link rod 70 for connecting the first parallel link 50 and the second parallel link 60 with each other, and the oil hydraulic cylinder 80 which is equipped on the frame 31 and connected to the first parallel link 50.

The oil hydraulic cylinder 80 has the cylinder tube 81 and a base end side of the cylinder tube 81 is rotatably connected to the frame 31 by the cylinder shaft 83 as shown in FIG. 4. In addition, a tip side of the piston rod 82 is rotatably connected to the first link rod 51 by a shaft 85.

Hereinafter, the hoisting/lowering movement of the seat part 24 by the hoisting/lowering mechanism 30' will be described.

When the seat part 24 is moved upward from the lowest position, the hairdresser steps on the hoisting switch 22*a* and then the oil hydraulic pump 23 applies the pressure to the oil hydraulic cylinder 80, thereby expanding the piston rod 82. Thereby, the first parallel link 50 rotates upward using the shafts 53 and 55 as axes. In this case, the third link rod 70 pushes up the second parallel link 60 with the rotational motion of the first parallel link 50. Thereby, the second parallel link 60 rotates upward using the shafts 64 and 66 as axes. As a result, the pedestal part 33 is moved upward with keeping a horizontal state.

Here, since the second parallel link 60 rotates in a counterclockwise direction around the shafts 64 and 66, the center position of the pedestal part 33 is moved forward as the pedestal part 33 is moved upward. However, since the first parallel link 50 rotates in a clockwise direction around the shafts 53 and 55 in connection with the rotational motion of the second parallel link 60, the link bracket 32 is moved backward as much as the center position of the pedestal part 33 is moved forward, whereby the center position of the pedestal part 33 is not displaced.

On the other hand, when the seat part 24 is moved downward, the hairdresser steps on the lowering switch 22*b* and then the oil hydraulic pump 23 decreases the pressure of the oil hydraulic cylinder 80, thereby contracting the piston rod 82. Thereby, the first parallel link 50 rotates downward using the shafts 53 and 55 as axes. In this case, the third link rod 70 pulls down the second parallel link 60 with the rotational motion of the first parallel link 50. Thereby, the second parallel link 60 rotates downward using the shafts 64 and 66 as axes. As a result, the pedestal part 33 is moved downward with keeping the horizontal state.

Here, since the second parallel link 60 rotates in a clockwise direction around the shafts 64 and 66, the center position of the pedestal part 33 is moved backward as the pedestal part 33 is moved downward. However, since the first parallel link 50 rotates in a counterclockwise direction around the shafts 53 and 55 in connection with the rotational motion of the second parallel link 60, the link bracket 32 is moved forward as much as the center position of the pedestal part 33 is moved backward, whereby the center position of the pedestal part 33 is not displaced.

In this way, the barber/beauty chair according to the second embodiment includes the hoisting/lowering mechanism 30' having two sets of parallel links, one set of the parallel link being disposed below the other set of the parallel link, and the rotational motion of the first parallel link 50 and the rotational motion of the second parallel link 60 which are in directions opposed with each other are connected with each other by the third link rod 70. Therefore, the displacements resulting from the rotational motions of the parallel links are cancelled out each other, whereby the seat part 24 can be moved upward and downward with being kept horizontal without displacement of the center position and the lowest position and the movable area of the seat part can be set freely.

What is claimed is:

1. A barber/beauty chair which has a mechanism for hoisting/lowering a seat part with keeping the seat part horizontal to a base part comprising:

a first parallel link having one end side which is rotatably connected to the base part and the other end side which is rotatably connected to a connecting member;

a second parallel link having one end side which is rotatably connected to the connecting member and the other end side which is rotatably connected to the seat part;

a cylinder device for rotating the second parallel link, the cylinder device having a base end side which is rotatably connected to the base part and a tip side which is rotatably connected to the second parallel link; and a connecting link for connecting a rotational motion of the first parallel link and a rotational motion of the second parallel link in opposed directions with each other, the connecting link having one end side which is rotatably connected to the first parallel link and the other end side which is rotatably connected to the second parallel link.

2. A barber/beauty chair which has a mechanism for hoisting/lowering a seat part with keeping the seat part horizontal to a base part comprising:

a first parallel link having one end side which is rotatably connected to the base part and the other end side which is rotatably connected to a connecting member;

a second parallel link having one end side which is rotatably connected to the connecting member and the other end side which is rotatably connected to the seat part;

a cylinder device for rotating the first parallel link, the cylinder device having a base end side which is rotatably connected to the base part and a tip side which is rotatably connected to the first parallel link; and a connecting link for connecting a rotational motion of the first parallel link and a rotational motion of the second parallel link in opposed directions with each other, the connecting link having one end side which is rotatably connected to the first parallel link and the other end side which is rotatably connected to the second parallel link.

* * * * *